US005702261A

United States Patent [19]

Wang

[11] Patent Number: 5,702,261

[45] Date of Patent: Dec. 30, 1997

[54] AUTO-TERMINATION NETWORK CABLE CONNECTOR

[75] Inventor: Tsan-Chi Wang, Hsin-Tien, Taiwan

[73] Assignee: Insert Enterprise Co., Ltd., Hsin-Tien, Taiwan

[21] Appl. No.: 630,575

[22] Filed: Apr. 10, 1996

[51] Int. Cl.[6] ..... H01R 29/00

[52] U.S. Cl. ..... 439/188; 439/944

[58] Field of Search ..... 439/188, 944, 439/607, 609, 610

[56] References Cited

U.S. PATENT DOCUMENTS 4,971,569 11/1990 Gooch et al. ..... 439/188 OR
5,030,122 7/1991 Birch et al. ..... 439/188 OR
5,073,123 12/1991 Birch et al. ..... 439/188 OR
5,503,566 4/1996 Wang ..... 439/188 OR

*Primary Examiner*—Neil Abrams
*Assistant Examiner*—Daniel Wittels
*Attorney, Agent, or Firm*—Bacon & Thomas

[57] ABSTRACT

An auto-termination network cable connector which includes an auxiliary connector for connection to network cable, a main connector for connection to workstation computer, and coaxial cables connected between the auxiliary connector and the main connector, wherein the auxiliary connector has a resistor of predetermined impedance at the center and a metal spring plate at each end to automatically form a terminator at each end upon the removal of the BNC plug therefrom; a metal shield is installed in the auxiliary connector surrounding the resistor, the central terminal of the auxiliary connector, and the central conductors of the coaxial cable to protect against electromagnetic interference.

2 Claims, 5 Drawing Sheets

AUTO-TERMINATION NETWORK CABLE CONNECTOR

BACKGROUND OF THE INVENTION

The present invention relates to network cable connectors, and relates more particularly to a BNC connector for use in an Ethernet which provides the function of auto-termination and, which effectively protects transmission signal against electromagnetic interference.

Following fast development of personal computers and telecommunication technology, computer application has been leading toward down sizing and local area network. This change promotes the application of computers in all industries. Nowadays, computer network systems have been intensively used in various fields. Therefore, like the installation of water pipings, electric and telecommunication pipings, computer network cables have to be installed during the construction of modern buildings like the installation.

Although FDDI, ATM network communication standards have been defined using optical cables, Ethernet will be still intensively used in offices in the near future. Basically, Ethernet has various wiring methods including 10 Base 5, 10 Base 2, and 10 Base T. The wiring method of 10 Base 5 uses transceiver to connect workstation computer to network cable. Nowadays, few network systems use this complicated wiring method. 10 Base T wiring method uses unshield twisted pair. The advantage of 10 Base T wiring method is that it can be conveniently installed by using existing telecommunication pipings. However, this wiring method cannot effectively protect against electromagnetic interference, and the distance between nodes is short. Furthermore, the network cable of this wiring method tends to be damaged by animals, for example, mouse, cockroach. 10 Base 2 wiring method allows the distance between nodes to be extend to as long as 185 meters, and can effectively protect against electromagnetic interference and the biting of animals. However, it is not easy to add an additional workstation computer after the installation of the network cable, and the network cable must pass through every workstation computer, therefore the line of network topology is prolonged. As illustrated, every Ethernet wiring method has its advantages and disadvantages. Therefore, 10 Base 2 and 10 Base T are simultaneously used in the arrangement of a local area network, so that 10 Base T can compensate the disadvantages of 10 Base 2. However, the wiring of Ethernet will be more flexible if 10 Base 2 provides a relatively broad application range.

According to conventional 10 Base 2 wiring method, BNC connector with coaxial cable (RG-58, 50Ω), BNC T type connector and terminator form one segment of the local area network, i.e., the main connector of each BNC T type connector is connected to the connector of the network card of the respective workstation computer, and the two auxiliary connectors of the BNC T type connector are respectively connected to the network cards of the other workstation computers through the coaxial cables, and a terminator is connected to each terminal of the network segment which is not connected to other network segments, so as to close the loop and to protect against the interference of noises. This is the basic structure of conventional Ethernet 10 Base 2 wiring method. If terminator is not properly installed, signal cannot be positively transmitted. Even if the terminal of every network segment is respectively installed with terminator, the network still cannot work properly when the network cable is broken at somewhere. Furthermore, because the network cable must pass through every workstation computer, it cannot be completely arranged under the floor and kept from sight. If the network cable is arranged in embedded pipings, a certain length of the network cable must be left out of embedded pipings at every node so that the position of respective workstation computer can be changed when required.

SUMMARY OF THE INVENTION

The present invention has been accomplished under the circumstances in view. It is one object of the present invention to provide a network cable connector which can extend the network cable to the desired location. Therefore, the network cable can be arranged in embedded pipings without precisely matching with the locations of workstation computers. When workstation computers are installed, network cable connectors of different sizes are selected and installed to connect workstation computers to the network cable. Therefore, the network cable can be kept from sight, and the locations of the workstation computers can be conveniently changed when required.

It is another object of the present invention to provide a network cable connector which provides the function of auto-termination. Therefore, no additional terminator is needed when expanding or changing the network topology structure, and the network cable connector of the present invention automatically terminates the circuit with a 50 Ω terminator therein.

It is another object of the present invention to provide a network cable connector which has shielding means that protects against electromagnetic interference from nearby electronic office machines, therefore signal collision is prevented.

It is still another object of the present invention to provide a network cable connector which automatically terminates the circuit when the network cable is broken by an external force, to keep signal transmission of the network in normal status.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
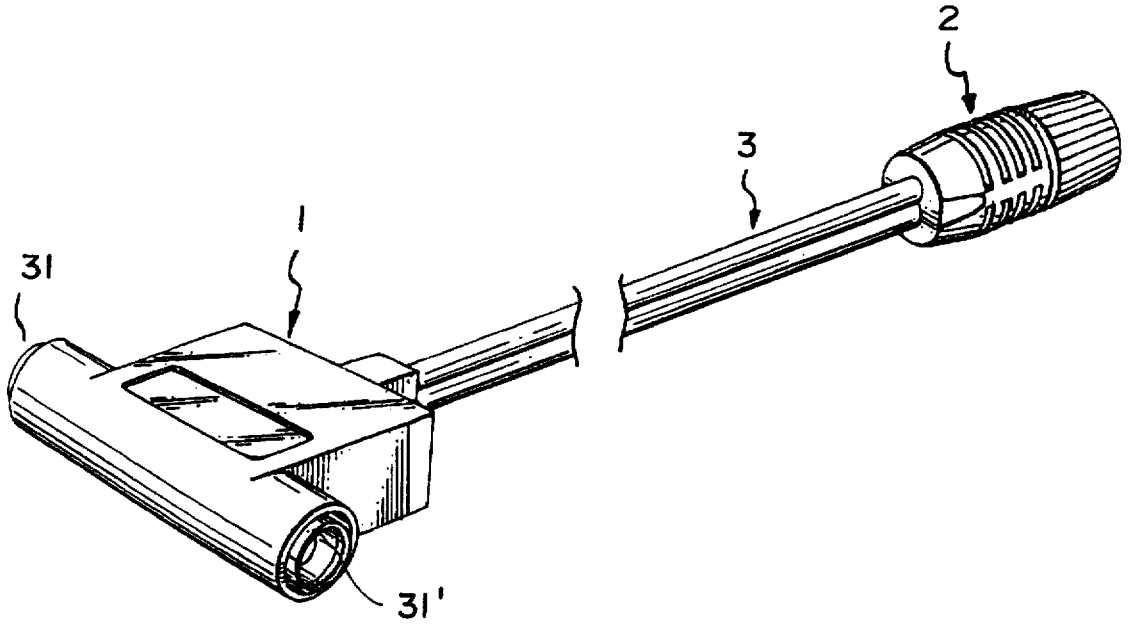
FIG. 1 shows the outer configuration of an auto-termination network cable connector according to the present invention.

Referring to FIG. 1, an auto-termination network cable connector in accordance with the present invention is generally comprised of a T type auxiliary connector 1, a main connector 2, and a plurality of coaxial cables 3 connected between the auxiliary connector 1 and the main connector 2. The T type auxiliary connector 1 has two BNC jacks 31, 31' at two opposite ends adapted for connection to network cables. The main connector 2 is a BNC plug adapted for connection to the network card of a workstation computer, for permitting the signal of the workstation computer to be transmitted to the computer network to which the auxiliary connector is connected.

Figure 2:
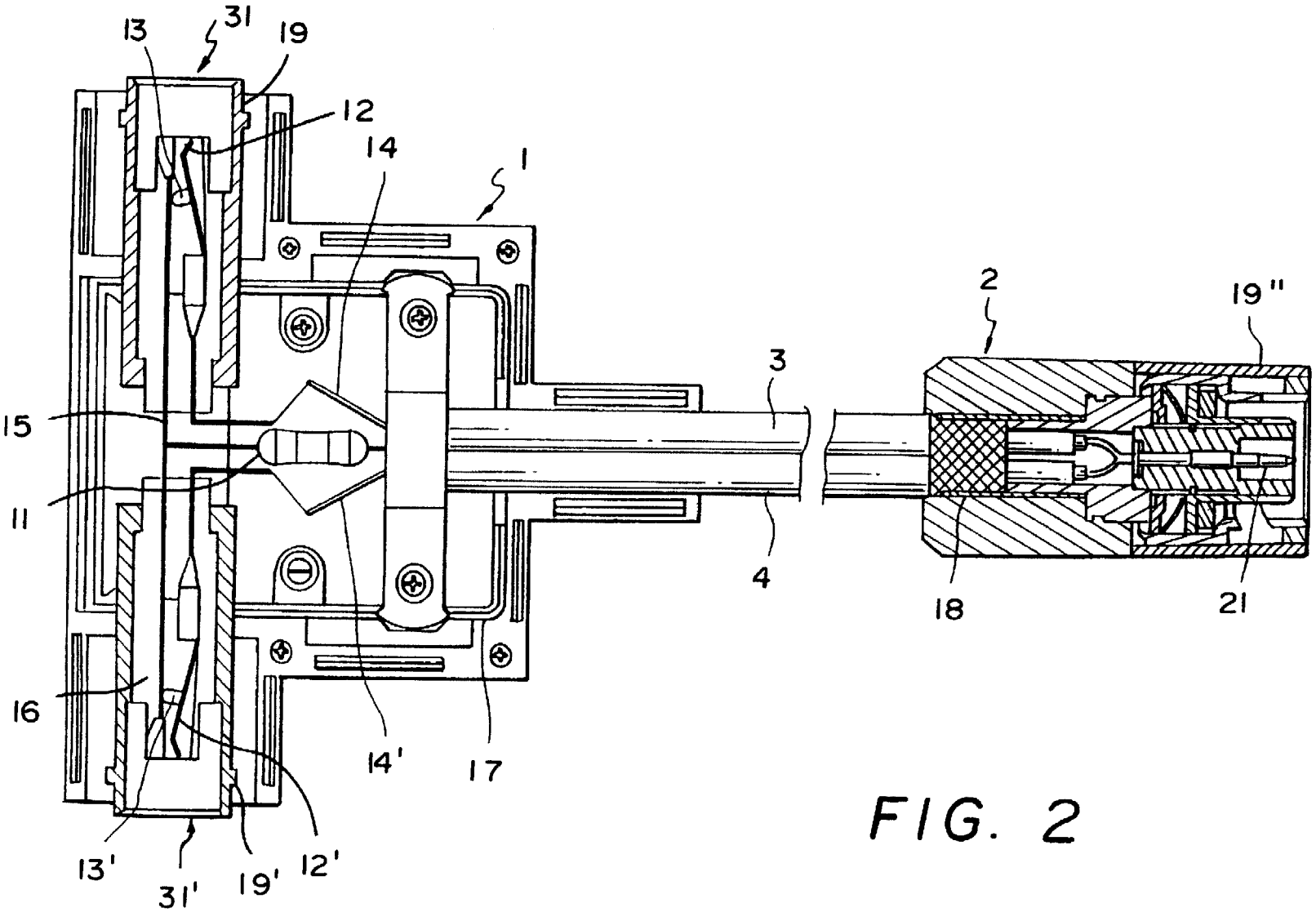
FIG. 2 is sectional view in an enlarged scale of FIG. 1.

Referring to FIG. 2, the BNC jack 31 of the auxiliary connector 1 uses a metal spring plate 12 to communicate with the central pin 21 of the BNC plug for input and output transmission of network signal. When the BNC plug is installed, the insertion of the central pin of the BNC plug forces the lug, referenced by 13, away from the central terminal, referenced by 15, to open the circuit. On the contrary, the lug 13 returns into contact with the central terminal 15 to close the circuit. The metal spring plate 12 is connected to the central terminal 14 of the coaxial cable 3 to transmit network signal to the central pin 21 of the main connector 2, permitting network signal to be further transmitted from the central pin 21 of the main connector 2 to the metal spring plate 12' of the other BNC jack 31' through the electrically connected coaxial cable 4, therefore network signal can be transmitted between the BNC jacks 31, 31' and the central pin 21. The central terminal 15 is normally retained in contact with the lugs 13, 13', and connected to the outer tubular conductors 18 of the coaxial cables 3, 4 through a 50 Ω resistor 11. However, an insulator 16 is mounted between the central terminal 15 and the tubular terminals 19, 19'. Therefore, network signal is allowed to be transmitted between tubular terminals 19, 19', 19" and the central terminal 15 via the 50 Ω resistor 11. Furthermore, a metal shield 17 is installed and covered over the central terminal 15 and the tubular terminals 19, 19' to protect them against electromagnetic interference, so as to eliminate signal collision.

Figure 3:
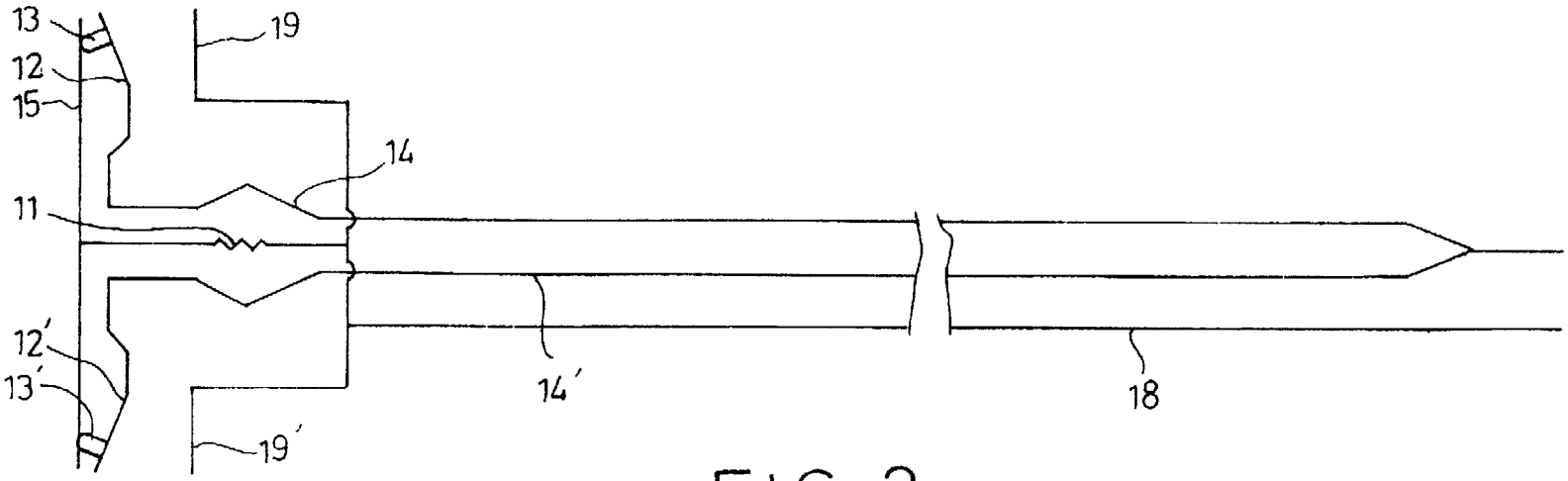
FIG. 3 is a schematic drawing, showing the internal arrangement of the auto-termination network cable of the present invention before its installation in the network system.

Referring to FIG. 3, when the network connector of the present invention is not connected to the network cable and the workstation computer, the lugs 13, 13' are stopped at the central terminal 15, which is connected to the tubular terminals 19, 19' through the resistor 11; the tubular terminals 19, 19' are connected to the tubular terminal 19" of the main connector 2 through the outer tubular conductors 18 of the respective coaxial cables; the metal spring plates 12, 12' are respectively connected to the central terminal 15 through the lugs 13, 13' when the central pin of the BNC plug is not installed, and the opposite ends of the lugs 13, 13' are respectively connected to the central conductors 14, 14'; the central conductors 14, 14' are respectively connected to the central pin 21 of the main connector 2. In order to show the transmission direction of the signal, the tubular terminal 19" and the central pin 21 are not specified in FIG. 3.

Figure 4:
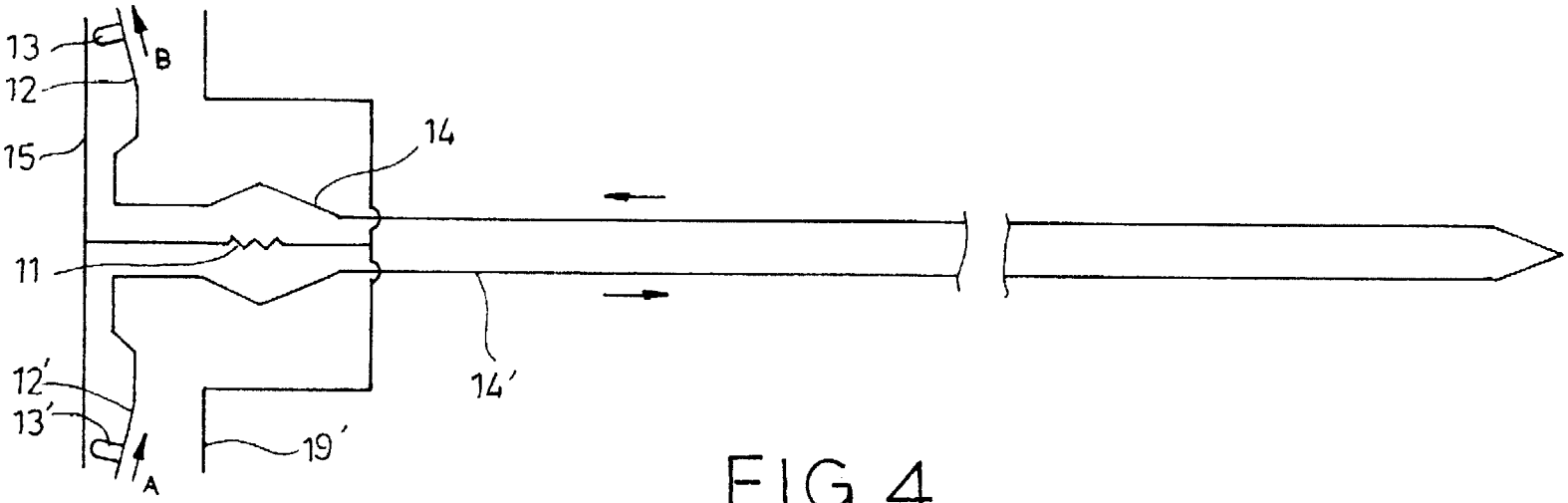
FIG. 4 is a schematic drawing showing the transmission direction of signal in the auto-termination network cable connector of the present invention when BNC plugs respectively connected to the BNC jacks of the auxiliary connector.

Referring to FIG. 4, when two BNC plugs are respectively connected to the BNC jacks of the auxiliary connector 1, the metal spring plates 12, 12' are forced by the central pins of the BNC plugs to move the lugs 13, 13' away from the central terminal 15, causing the circuit to be cut off, therefore signal is inputted from arrow A through the metal spring plate 12', then sent through the central conductors 14', 14 to arrow B via the metal spring plate 12 without passing through the resistor 11, and vise versa.

Figure 5:
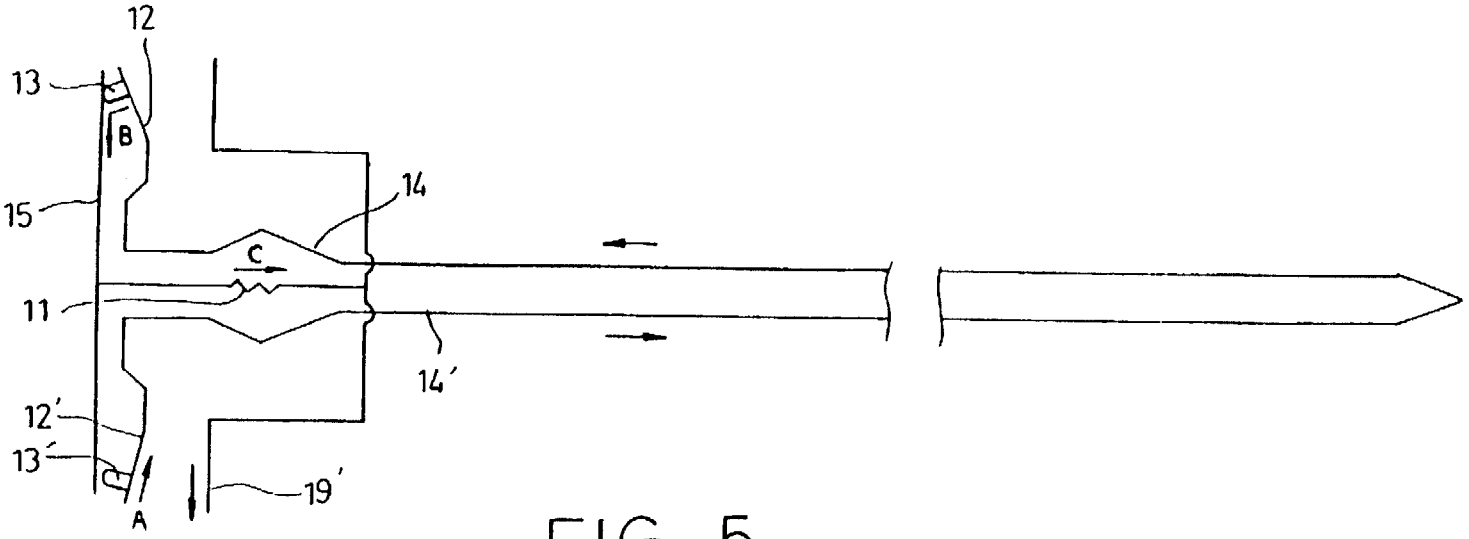
FIG. 5 is a schematic drawing showing the transmission direction of signal in the auto-termination network cable connector of the present invention when one BNC jack automatically terminated.

Referring to FIG. 5, when only one end of the auxiliary connector 1 is electrically connected, signal is inputted into the metal spring plate 12' (see arrow A), then transmitted through the central conductors 14', 14 to the metal spring plate 12, however because the lug 13 is disposed in contact with the central terminal 15, therefore signal is transmitted in the direction indicated by arrows B, C through the resistor 11 to the tubular terminal 19' to form a loop, and therefore the circuit is automatically terminated.

Figure 6:
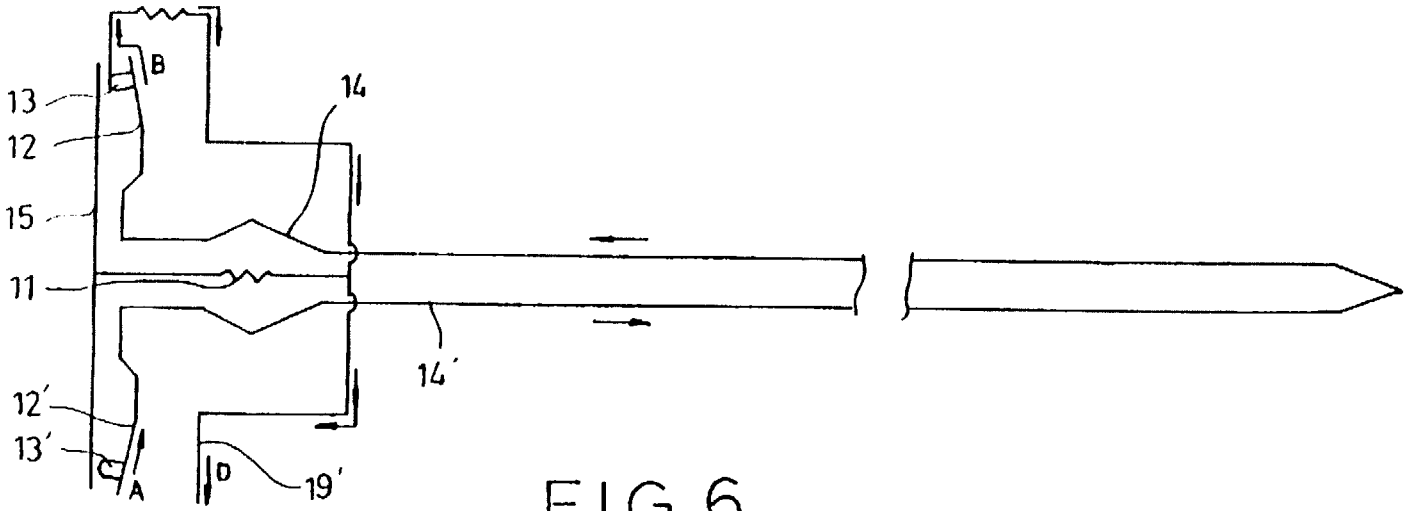
FIG. 6 is a schematic drawing showing the transmission direction of signal in the auto-termination network cable connector of the present invention when one BNC jack automatically terminated and the main connector connected to the network cable.

The automatic termination function of the network cable connector does not affect the normal operation of the network. FIG. 6 shows one end of the auxiliary connector 1 connected to a BNC plug, and the other end thereof terminated, i.e., the network cable connector is installed in one terminal of the network cable. As illustrated, signal is inputted into the metal spring plate 12' (see arrow A), then transmitted through the central conductors 14', 14, then the lug 13, and then the resistor 51 (see arrow B), and then outputted through the tubular terminal 19' (see arrow D).

As indicated, the network cable connector provides a broad application range. By using network cable connectors of different sizes, a plurality of workstation computers can be respectively connected to the network with less amount of the network cable exposed to the outside. Furthermore, the auto-termination function of the network cable connector of the present invention enables every node of the network cable to provide the function of auto-termination. When the connection between one BNC plug and one BNC jack in the network is broken, it is automatically terminated without affecting the transmission of signal of the network. Furthermore, the metal shield covers over the resistor, most part of the central conductors and the terminals of the auxiliary connector, therefore the interference of electromagnetic noises is reduced.

Figure 7:
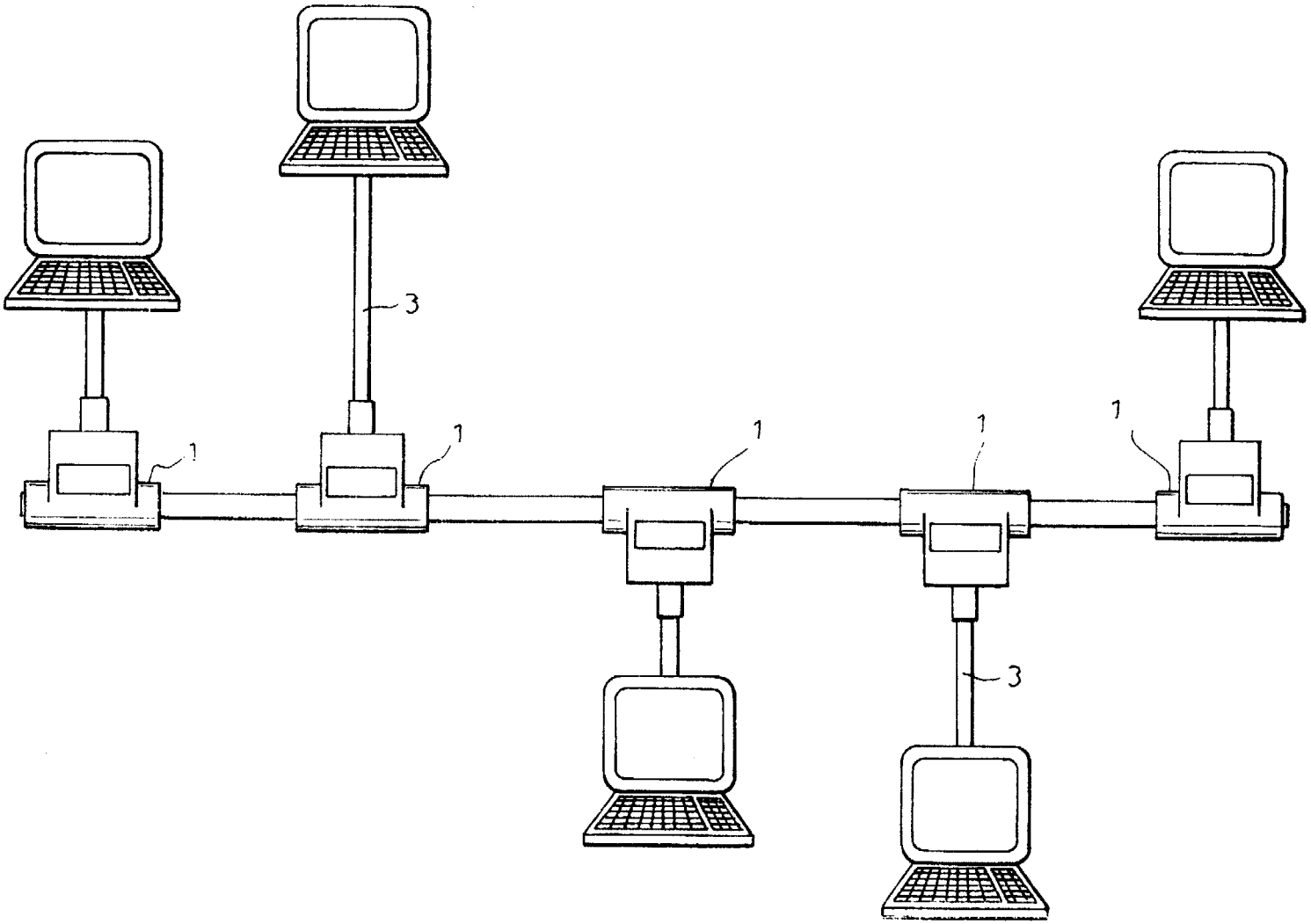
FIG. 7 is an applied view of the present invention, showing auto-termination network cable connectors of different lengths connected between the workstation computers and the network cable.

FIG. 7 is an applied view of the present invention showing a plurality of workstation computers installed in a network system and respectively connected to the network cable by a respective network cable connector. This installation method eliminates the use of any terminator.

While only one embodiment of the present invention has been shown and described, it will be understood that various modifications and changes could be made without departing from the spirit and scope of the invention disclosed.

What the invention claimed is:

1. An auto-termination network cable connector for a computer network system, comprising an auxiliary connector for connection to a network cable of a computer network system, a main connector having a central pin and a tubular side terminal around said central pin for connection to a workstation computer, and a plurality of coaxial cables connected between said auxiliary connector and said main connector, wherein: said auxiliary connector comprises a first BNC jack and a second BNC jack at opposite ends of the auxiliary connector for connection to the network cable of the computer network system, each of said BNC jacks comprising a central terminal, a tubular side terminal around said central terminal, and a metal spring plate connected to the central conductor of one of said coaxial cables and having a lug disposed in contact with said central terminal, said metal spring plate being connected to the central pin of said main connector, permitting an electric signal to be transmitted from the metal spring plate of said first BNC jack through the central pin of said main connector to the metal spring plate of said second BNC jack, the central terminal of said first BNC jack being the central terminal of said second BNC jack and connected to the outer conductors of each of said coaxial cables through a resistor, permitting the tubular side terminals of said first BNC jack and second BNC jack and said main connector to be electrically connected to said central terminal through said resistor; said auxiliary connector comprising an external metal shield surrounding said resistor, the central conductors of said coaxial cables, and said central terminal to protect these elements from electromagnetic interference.

2. The auto-termination network cable connector of claim 1 wherein the central conductors of said coaxial cables are respectively connected to one end of the central pin of said main connector.

* * * * *